United States Patent [19]

Russell

[11] Patent Number: 4,480,558

[45] Date of Patent: Nov. 6, 1984

[54] ADJUSTABLE AIR INLET CONTROL SYSTEM

[76] Inventor: Robert J. Russell, 1332 Lymric Way, Bakersfield, Calif. 93309

[21] Appl. No.: 433,512

[22] Filed: Oct. 8, 1982

[51] Int. Cl.[3] ..... F23L 1/02

[52] U.S. Cl. ..... 110/297; 110/310

[58] Field of Search ..... 110/297, 309, 310, 313; 126/110 A

[56] References Cited

U.S. PATENT DOCUMENTS

| | | | |
|---|---|---|---|
| 201,638 | 3/1878 | Walworth . | |
| 688,049 | 12/1901 | Yates . | |
| 1,320,298 | 10/1919 | Walborn . | |
| 1,562,087 | 11/1925 | Griswold . | |
| 1,572,687 | 2/1926 | Schmelz . | |
| 1,670,295 | 5/1928 | Bailey | 110/310 |
| 1,775,065 | 9/1930 | Brown . | |
| 1,848,850 | 3/1932 | Sturgis . | |
| 1,854,289 | 4/1932 | Barker . | |
| 1,905,734 | 4/1933 | Morrow . | |
| 1,963,073 | 6/1934 | Butler | 236/45 |
| 1,973,997 | 9/1934 | Roberts | 236/45 |
| 2,008,240 | 7/1935 | Byrne | 236/16 |
| 2,061,587 | 11/1936 | Morris | 110/163 |
| 2,126,994 | 8/1938 | Irsch | 36/19 |
| 2,179,940 | 11/1939 | Lawson | 236/45 |
| 2,186,354 | 1/1940 | Whetstine | 126/293 |
| 2,291,018 | 7/1942 | Bachman | 236/45 |
| 2,297,757 | 10/1942 | Field, Jr. | 236/45 |
| 2,340,283 | 1/1944 | Vladu | 126/293 |
| 2,355,740 | 11/1945 | Cole | 236/45 |
| 2,388,253 | 11/1945 | Dady | 236/45 |
| 2,396,777 | 3/1946 | Edwards | 110/147 |
| 2,411,398 | 11/1946 | D'Elia | 126/293 |
| 2,433,749 | 12/1947 | Field, Jr. | 236/45 |
| 2,435,166 | 1/1948 | Stephenson | 236/45 |
| 2,539,815 | 1/1951 | Dady | 236/45 |
| 2,546,714 | 3/1951 | Bataille | 110/163 |
| 2,555,687 | 6/1951 | Field, Jr. | 236/45 |
| 2,557,210 | 6/1951 | Viola et al. | 126/307 |
| 2,687,256 | 8/1954 | Puffer | 236/45 |
| 2,735,385 | 10/1954 | Ascentiis | 110/163 |
| 2,743,056 | 9/1956 | Hubbard | 236/45 |
| 2,783,756 | 3/1957 | Crozier | 126/292 |
| 2,819,845 | 1/1958 | Ziph | 236/45 |
| 3,070,312 | 12/1962 | Steinen | 236/45 |
| 3,208,670 | 9/1965 | Pfister | 236/45 |
| 3,297,251 | 1/1965 | Pfister | 236/45 |
| 3,362,634 | 1/1968 | Steinen | 236/45 |
| 4,027,654 | 6/1977 | Kannapell | 126/285 |
| 4,262,608 | 4/1981 | Jackson | 110/162 |

FOREIGN PATENT DOCUMENTS

| | | | |
|---|---|---|---|
| 102651 | 3/1897 | Fed. Rep. of Germany | 110/297 |
| 12939 | 2/1909 | United Kingdom | 110/297 |
| 542256 | 1/1942 | United Kingdom | 110/297 |
| 2040422 | 8/1980 | United Kingdom . | |
| 850985 | 7/1981 | U.S.S.R. | 431/114 |

*Primary Examiner*—Edward G. Favors

*Attorney, Agent, or Firm*—Knobbe, Martens, Olson & Bear

[57] ABSTRACT

A rectangular air inlet control plate is pivotably mounted in the air intake passage of a forced air furnace to control the air intake volume and, thereby, insure optimal combustion of the fuel in the furnace. The plate is adjustably counter-balanced to a closed position and is further adjusted to allow the optimum volume of air intake during operation of the forced air furnace. The rectangular shape of the plate provides for fast opening and closing of the air intake during startup and shutdown transients, since the actuation angle of the plate is reduced in proportion to its length. The plate is mounted in a funnel-shaped air intake structure to reduce the noise and allow a maximum volume of air to enter the intake. A windscreen is mounted on the funnel-shaped air intake in order to act as a turbulence breaker for the incoming air, and also to prevent ingestion of large debris into the air intake.

12 Claims, 3 Drawing Figures

ADJUSTABLE AIR INLET CONTROL SYSTEM

BACKGROUND OF THE INVENTION

The present invention relates to an adjustable air intake, or draft control plate which is located in the air inlet portion of a forced air draft furnace for the purpose of controlling the air intake volume, thus insuring optimum combustion of the fuel in the furnace.

Forced air furnaces burning gas, coal, and oil are very prevelant in our society, especially in industrial and commercial applications. One common use of forced air furnaces is a "heater treater." As crude oil is pumped from oil wells, it contains many entrained impurities such as water, dirt and other solids, which will not settle out of the viscous crude oil. As this crude oil is pumped from the ground, it is pumped into a "heater treater" which raises the temperature of the crude oil. Since the heated crude oil has a lower viscosity, the entrained water, dirt and other solids can separate out and settle.

These heater treaters operate in remote pump locations, thus it is very desireable to have the forced air furnace operate with minimum operator control and maintenance. The present practice on the heater treaters is to place a manual control on the forced air intake in order to control the volume of the air intake. It is not uncommon for an improper manual adjustment of the air intake volume to throw the heater treater furnace into a mode where it oscillates between excess oxygen and an insufficient oxygen condition. Both conditions are extremely inefficient from the standpoint of fuel consumption and the latter can cause the heater treater to emit black smoke, thus falling below minimum air pollution standards. If this oscillation exceeds a predetermined value for minimum oxygen in the furnace, a safety mechanism immediately shuts down the heater treater furnace. The furnace shut down results in dirty crude oil being pumped into a storage tank, which in turn contaminates the rest of the oil in the storage tank. The particulate contamination levels in the storage tank may render the entire bulk of crude oil unsaleable without additional processing. Since the heater treaters are located in remote locations, it may be a matter of hours before someone comes along and restarts the furnace. Thus, there is a clear need for a more reliable system which regulates the air intake on forced air furnaces.

Additionally, the heater treater furnaces are constantly being turned on and off as the temperature and volume of the incoming crude oil varies. When the forced air furnaces are initially turned on, or shut off, the amount of air required to operate the furnace at its optimum conditions goes through several oscillations before settling out to a relatively constant volume of air. A fixed opening on the air intake does not provide for efficient furnace operation during these start up and shut down transients. Thus, there is a need for a fast operating, automatic controller on the air intake in order to make the furnace operation more efficient during the start up and shut down transients.

Another example of forced air furnaces used in the oil industry is a steam generator. In order to increase the oil production of wells, it is common practice to inject hot water or steam into the ground in order to make the crude oil less viscous and, hence, easier to extract. In order to provide a measure of control, the temperature of the oil casing is monitored and used to determine the temperature of the steam being injected into the ground.

Present forced-air systems control both the air intake rate and the rate of fuel consumption in an attempt to vary the temperature of the injected steam. These numerous variables lead to a complex instrumentation system for controlling the forced air furnaces. The complexity is increased on some steam generating systems which controllably recycle the vent gas in order to increase the temperature of the incoming air and to decrease the oxygen going to the furnace.

The large number of variables which can affect the optimum operation of these forced air furnaces, leads to a significant amount of operator discretion in determining furnace operation. Since each operator exercises his or her discretion differently, the efficiency of the operation of the forced air furnaces varies considerably. It is thus desireable to have a simple, yet efficient operational method for the forced air furnace which will minimize the discretion of the operator.

SUMMARY OF THE INVENTION

The adjustable air intake control plate of the present invention fills an existing need for providing a simple, yet efficient means of controlling the air intake volume on forced air furnaces in order to provide optimum combustion with low maintenance, and control. The present invention is capable of fast operation in order to vary the amount of air intake during transient conditions such as start up and shut down. As a result, the present invention can also be utilized under natural draft conditions.

In this invention, an air intake control plate is pivotally mounted in an air intake enclosure so as to be able to substantially block the passage of air through the enclosure. The air intake control plate of the present invention is rectangular in shape. The plate is pivotally mounted to rotate about an axis passing at a right angle to the longitudinal dimension of the rectangle; alternately stated, the pivot axis is parallel to the axis producing the maximum moment of inertia. The pivot axis can be located at one end of the rectangle, or, if part of the plate's weight is to be used as a counter balance, then the pivot axis is located more toward the center of the rectangular control plate.

The pivoting of the control plate allows maximum sensitivity of the plate. The longer the pivoted portion of the control plate, the smaller the angle of actuation required to vary the volume of the incoming air.

The air intake control plate is counter weighted to a closed position wherein the control plate blocks the air passage running through the air intake enclosure. The counter weight is manually adjustable in order to allow the control plate to vary the amount of incoming air during operation of the forced air intake. Depending on the location of the control plate's pivot axis, part of the plate weight may act as a counter balance.

The air intake control plate is pivotally mounted at an angle to the axis of the air intake opening. This orientation allows the control plate to obtain a lever effect whereby a small rotation of the plate can affect a relatively large change in the unobstructed area of the air intake passage and, hence, a large change in the volume of incoming air. In this inclined orientation, the air intake control plate is also more sensitive to the force exerted by the incoming air, hence increasing the plate's sensitivity to the furnace's air demands.

The adjustable counter weight is used to position the control plate so as to adjust the size of the air inlet opening when the forced air furnace is operating at its full capacity. This adjustment is determined by measuring the amount of oxygen in the exhaust stack of the furnace. Since a high percentage of oxygen in the exhaust stack means there is insufficient fuel, and a low percentage or absence of oxygen in the exhaust stack means there is too much fuel and insufficient air, the oxygen content is a valid measure of the optimum combustion efficiency. The counter weight is set so that the rectangular control plate permits sufficient air to be taken into the forced air furnace when operating a maximum fire setting, so that the oxygen content in the exhaust stack measures 2%. The counter weight typically need not be adjusted thereafter.

Some forced air furnaces contain two blowers and operate at both high-firing and low-firing levels. The counterweight is set on one blower to operate at the low-firing setting. The counter weight on the other blower is set for the high-firing level. Thus, during low fire, only one blower would be used, since the high-fire blower would remain with the control plate counter weight closed. Both blowers would be in operation during the high-firing level since the air intake force on the low-fire blower would exceed the counter balance weight on that blower. Thus, efficient operation at both the high-firing level and the low-firing level is obtained with a two-blower forced air furnace.

The counter weight mechanism is a single adjustable counter weight mounted on the pivot shaft of the rectangular plate. Alternately, two counter weights may be fastened to the pivot axle (one on either side of the plate) if the pivot axle is not sufficiently strong to take the torque exerted by a single counter weight.

Two air intake control plates could also be used on a single air intake. In one embodiment of this two-plate configuration, each of the air intake control plates would be counter weighted to rest against a common stop so as to block the air passageway of the intake. A separate counter weight for each plate is provided. Hence, the amount of air entering through each control plate would be separately controllable. Thus, it would be possible to control the amount of air mixing with recycled flue gas by adjusting one control plate, and to also control the amount of mixed air which enters the forced air furnace, by adjusting the second control plate; or finally, to set one control plate for a high firing level, and one control plate for a low firing level to allow optimum combustion at both firing levels with only one air intake enclosure.

The rectangular air intake control plate is mounted in a funnel-shaped air intake enclosure, so that the air passageway in the enclosure can be substantially obstructed by the control plate. The enclosure is more accurately described as a truncated pyramid of four sides, the opposing sides being symmetric in shape. The structure cross section taken perpendicular to the air passageway axis is a square at one end, and a rectangle at the opposite end. The square end is provided with a flange to mount the enclosure on the air intake opening of the furnace.

The funnel-shaped air intake enclosure serves several purposes. The funnel shape allows more air to enter when the rectangular plate is in the full open position by reducing the dimension of the drag-induced boundary layer. The funnel shape also reduces the noise generated by the air intake, probably because the enclosure effectively lowers the intake air velocity at the mouth of the funnel. Also, the large funnel mouth reduces the possibility that a large percentage of the air intake area will be blocked by the partial ingestion of a foreign object. For example, a ten-square-inch piece of tarpaper which is sucked against the rectangular end of the funnel will have little effect on a large funnel whereas the same piece of tarpaper could totally block the actual intake area at the throat of the funnel.

A turbulence screen is placed over the rectangular end of the air intake funnel. This screen serves as a turbulence breaker to minimize the effects of atmospheric conditions, such as wind, on the amount of air drawn into the funnel by the forced air blower. Additionally, the screen serves to prevent the ingestion of large objects into the air intake enclosure and forced air blowers.

The smoothing effect that the screen will have on atmospheric conditions allows the air intake to operate in a more constant manner than was heretofore possible. The turbulence screen, working in combination with the funnel-shaped air intake, thus provides for a maximum and uniform amount of air to the forced air furnace, thereby allowing the furnace to function at its maximum efficiency.

The use of the preset and counter weighted air inlet control plate removes the need to have continual adjustment of the air intake by maintenance or operational personnel. The simplicity of the design on the air intake control plate, when combined with the increased operating efficiency resulting from using the control plate, are significant advancements over the prior art.

DETAILED DESCRIPTION OF THE PREFERRED EMBODIMENT

Figure 1:
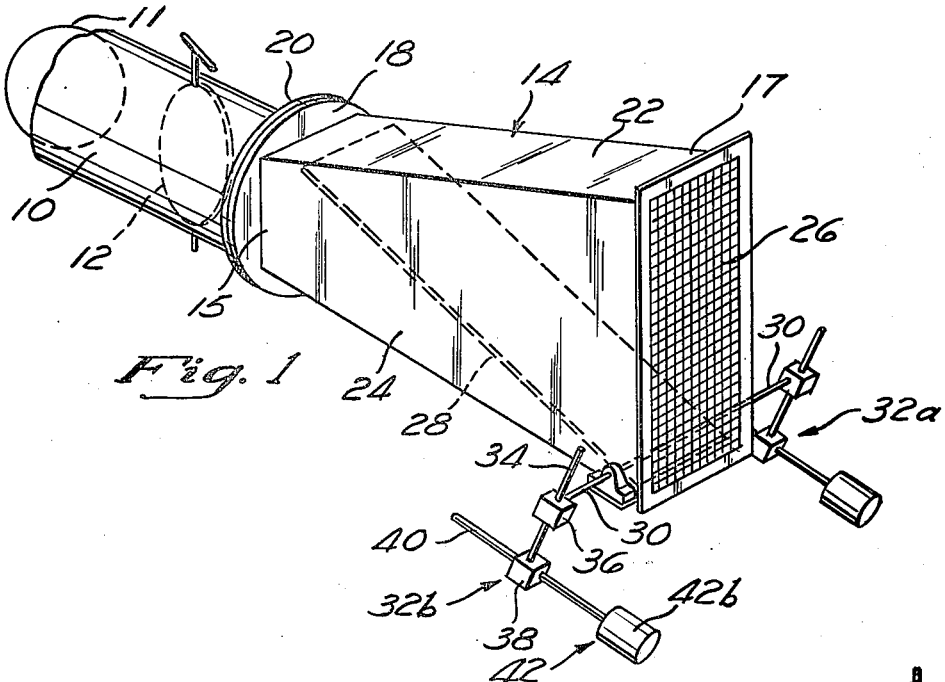
FIG. 1 shows a perspective view of the present invention illustrating the funnel-shaped air intake enclosure mounted on the air intake opening of a blower used on a forced air draft furnace.
Figure 2:
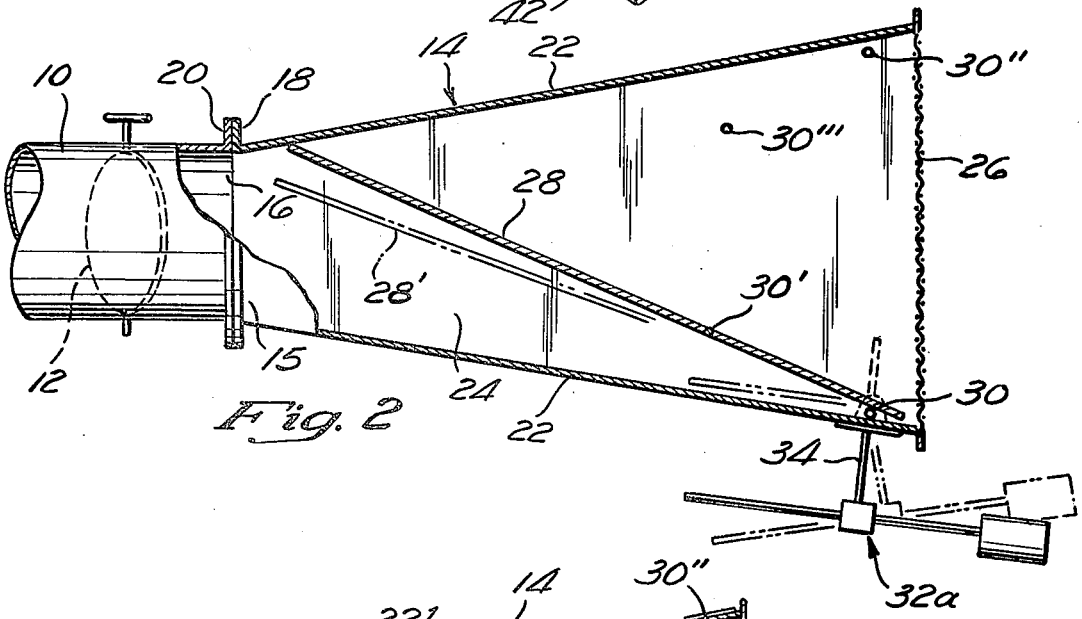
FIG. 2 is a side view of the present invention, partially cut away to illustrate the detailed construction of the air intake control plate as it interfaces with the funnel-shaped air intake.

Referring to FIGS. 1 and 2, there can be seen the typically round shape of the air inlet 10 of an existing forced air furnace 11. A blower (not shown) is located so as to suck ambient air through the air inlet 10 and into the furnace. A manual damper 12 is typically provided in the air inlet 10 in order to allow for coarse manual adjustment of the volume of inlet air. The funnel-shaped air intake enclosure 14 (hereinafter air intake 14) of the present invention is shown mounted at the opening 16 of the air inlet 10. The air intake 14 has a square shape at the proximal end 15 of the air intake 14 adjoining the air inlet 10. In order to mount the square end of the air intake 14 onto the air inlet 10, an interface flange 18 is provided on the square end of the air intake 14. Interface flange 18 mates with a corresponding flange 20 mounted on the air intake 10.

As shown in FIG. 1, the distal end 17 of the air intake 14 which is opposite the interface flange 18 has a rectangular shape, the dimensions of the rectangle being greater than the dimensions of the smaller square end of the air intake 14. The air intake 14 thus forms a truncated pyramid having opposing sides of said pyramid of equal dimensions. Two rectangular side plates 22 oppose one another and have their long edges joined to the long sides of trapezoidal sides 24 so as to form the truncated pyramid which constitutes the air intake 14. The air intake 14 thus forms an air passageway which is rectangular in shape at the distal end 17, and square shaped at the other proximal end 15, which is joined to interface flange 18.

As merely one dimensional example, the interface flange 18 is 23 inches in diameter, the square end of the air intake 14 is 14 inches on a side. The rectangular end of the air intake 14 is 28 inches by 14 inches. The length of rectangular side plate 22 is approximately 35 inches. The angle between the axis of the air passageway through the funnel-shaped air intake 14 and the rectangular side plate 22 is approximately 30 degrees. However, the air intake 14 of the present invention can function equally as well while having various other shapes and configurations.

The funnel shape of air intake 14 serves several purposes. The funnel shape allows more air to enter when control plate 28 is in the full open position by reducing the dimensions of the drag induced boundary layer. The funnel shape also reduces the noise generated by the air intake 14, probably because the enclosure effectively lowers the intake air velocity at the mouth of the funnel. Also, the large funnel mouth reduces the possibility that a large percentage of the air intake area will be blocked by the partial ingestion of a foreign object into air intake 14.

A turbulence screen 26, shown in FIG. 1, is placed over the rectangular end of the air intake 14. The turbulence screen 26 is generally rectangular in shape and typically consists of interwoven wires or rods which regularly intersect at angles to one another to form a repetitive grid. Turbulence screen 26 serves as a turbulence breaker to minimize the effects of atmospheric conditions, such as wind, on the amount of air drawn into air intake 14 by a forced air blower or by the natural draft of a furnace. Additionally, the screen serves to prevent the ingestion of large objects into the air intake 14. The smoothing effect that turbulence screen 26 will have on atmospheric conditions, allows the air intake to operate in a more uniform manner than was heretofore possible. Turbulence screen 26, working in combination with the funnel shape of air intake 14, thus provides for a maximum and constant amount of air to the furnace, thereby allowing the furnace to function at its maximum efficiency.

As shown in FIGS. 1 and 2, the rectangular air intake control plate 28 (hereinafter control plate 28) is pivotally mounted in the air intake 14 so as to be substantially able to obstruct the air passageway through the air intake 14. One end of the control plate 28 is located towards the square end of the air intake 14 and counterweighted so that the control plate 28 is in contact with rectangular side plate 22 of the air intake 14. The other end of the control plate 28 is located towards the turbulence screen 26. The control plate 28 is pivotally mounted on pivot axis 30 at the end of the control plate 28 nearest the turbulence screen 26. Pivot axle 30 passes at a right angle to the longitudinal dimension of the control plate 28 so that the control plate 28 rotates about an axis parallel to the axis producing the maximum moment of inertia of the control plate 28. Pivot axle 30 can be rotatably mounted on one of the rectangular side plates 22 at the end said plate nearest the turbulence screen 26, or alternatively mounted on the trapezoidal sides 24 toward the rectangular end 17 of air intake 14.

Pivoting the control plate 28 about pivot axle 30 thus allows maximum sensitivity of the control plate 28. The longer the pivoted portion of the control plate 28, the greater the motion at the end of control plate 28 near the square end of the air intake 14. This motion sensitivity is a direct result of a lever arm effect whereby a small angle of rotation causes a greater motion with a longer lever arm. The elongate length of the control plate 28 gives rise to a multiplier effect wherein a small rotation about the pivot axle 30 produces a much larger movement of control plate 28 at the end of the said plate nearest the throat of the air inlet 10, thereby providing increased sensitivity of response for the control plate 28. Additionally, the angle of incidence between the incoming air and the control plate 28 is relatively small. Thus, small rotations of control plate 28 about pivot axle 30 result in a relatively large change in the plate area which is exposed to the force of the incoming air. Thus, the control plate 28 becomes more sensitive to fluctuations in the incoming air velocity and also sensitive to pressure changes exerted by the air intake blowers or by natural draft variations in furnace air requirements. Such fluxations commonly occur during the frequent startup and shutdown of furnaces.

The control plate 28 can pivot about pivot axle 30 so as to substantially block the air passageway through the air intake 14, or alternately, pivot to a position substantially parallel to the rectangular side plate 22 near which the pivot axle 30 is mounted, in which case the air intake passageway is substantially unobstructed, or open.

The dimensions of a control plate 28 corresponding to the previously given exemplary dimensions of one embodiment of this invention would yield a control plate 28, 14 inches wide by some 35 inches long. In one particular test application of this invention, when the control plate 28 was set so as to allow optimum operation of the forced-air furnace, the shortest distance between the rectangular side plate 22 and the free end of the control plate 28, is approximately 2 inches. This dimension allows for a 2-inch by 14-inch rectangular-shaped air passageway near the square end 15 of the air intake 14. The angle through which rectangular control plate 28 must rotate to yield this 2-inch opening is approximately 2.5 degrees as indicated at 28' in FIG. 2. Rotating the same control plate 28 through an angle of approximately 28 degrees leaves the air passageway to the air intake 14 substantially unobstructed.

Counter-weights **32*a* and 32*b* are mounted to the pivot axle 30 and adjusted to bias the free end of control plate 28 into contact with the rectangular side plate 22, thereby substantially obstructing the air passageway through the air intake 14. The counterweights 32 consist of a mounting bracket 36, fixedly attached to pivot axle 30 and through which rod 34 is adjustably and slightably mounted. Rod 34 is radially oriented with respect to pivot axle 30. On the end of rod 34 is a second mounting bracket 38 through which rod 40 is adjustably and slidably mounted. Rod 40 is oriented perpendicular to rod 34 and tangential to a line running radially outward from pivot axle 30 to mounting bracket 38. On the end of rod 40 is a counter weight 42. Both counter weights 32*a* and 32*b* are of comparable construction. The counter weight 32 is adjusted by sliding rods 40 and 34 in their respective mounting brackets 38 and 36** in order to selectively vary the torque which counter weight 42 will exert upon pivot axle 30 and hence upon control plate 28.

In operational use, the counter weights 32*a* and 32*b* are adjusted so that the control plate 28 selectively obstructs the air passageway in the air intake 14. The amount by which the control plate 28 obstructs the air passageway to the air intake 14 is determined by adjusting the counter weight 32 until the resultant air passageway allows sufficient oxygen to enter the furnace for optimal combustion. Optimal combustion is determined by measuring the oxygen content in the exhaust gas of the furnace. An oxygen content of 2% is nominally considered optimal for forced air furnaces operating at full firing level.

As the forced air blower is turned on, the incoming air entering through the turbulence screen 26 forces the control plate 28 to rotate about pivot axel 30 so as to responsively open the air passageway through air intake 14 and rotate against the counter weight torque. The counter weight 32 is then adjusted to enlarge or narrow the air inlet opening formed by the control plate 28 and the square end of air intake 14. When the oxygen content in the exhaust stack reads approximately 2% the counter weights 32 are properly adjusted.

In the aforegiven dimensional examples, the two inch by fourteen inch rectangular opening near the square shaped end 15 of the air intake 14 results in optimal combustion in the forced air draft furnace as evidenced by an oxygen content of 2% in the exhaust gas of said furnace. Counter weight 32 does not normally need to be adjusted once it is set.

Several variations of the counter weight 32 orientation are possible without exceeding the scope of this invention. For example, a single counter weight can be used instead of two counterweights 32*a* and 32*b*, provided the pivot axle 30 is sufficiently strong to withstand the increased stress caused by placing the entire counter weight on one end of pivot axle 30.

The embodiment of this invention illustrated in FIGS. 1 and 2 shows the air passageway and the air intake 14 in a substantially horizontal position. The invetion is not limited to this orientation. As long as the counter weight 32 is properly adjusted, this invention can be oriented so that the air intake 14 is located on any of three mutually perpendicular axis or on a skew axis. The counter weight 32 need only be properly adjusted so as to maintain the control plate 28 in a closed position against the rectangular side plate 22; the counter weight 32 being additionally adjusted so as to provide for the correct air inlet opening when the forced air furnace is operating in its full fire position.

Referring to FIG. 2, there are shown pivot axle locations 30′, 30″ and 30‴, which illustrate possible variations on mounting control plate 28. Pivoting control plate 28 about the pivot axle 30′ would mean that the pivot axle 30′ is rotably mounted on the trapezoidal sides 24 of the air intake 14. That portion of the control plate 28 located between the pivot axle 30′ and the turbulance screen 26 acts as a counterweight tending to hold the end of the control plate 28 nearest the square end of the air intake 14 in contact with the rectangular side plate 22 of the air intake 14. Pivot axle 30′ allows the use of a shorter lever arm effect in that the portion of the control plate 28 located between the pivot axle 30′ and the end of the control plate 28 nearest the square end of the air intake 14 is shorter than if the control plate 28 rotated about pivot axle 30. Thus, relocating pivot axle 30 to pivot axle 30′ reduces the sensitivity of the control plate 28 by reducing the moment arm effect. For example, rotating the control plate 28 about pivot axle 30 required only a 28 degree rotation of the control plate 28 in order to substantially unblock or open the air passageway through the air intake 14. Conversely, rotating the control plate 28 about pivot axle 30′ requires a rotation of about 36 degrees in order to substantiate unblock the square shaped end of air intake 14. In order to provide for a 2-inch by 14-inch opening at the square end 15 of air intake 14, when the control plate 28 is rotated about pivot axle 30′ a rotation angle of approximately 3.5 degrees is required.

Locating the pivot axle 30′ at a distance approximately ⅓ the length of the control plate 28 also allows the use of a smaller counter weights 32 since part of the control plate 28 acts as a counter weight. Pivot axle 30′ also allows varying the sensitivity of the control plate 28 by varying the inertia of the pivoted control plate 28.

This invention thus allows for substantial flexibility in adjusting the sensitivity of the control plate 28 as well as flexibility in the design of counter weight 32 and the orientation of the air intake 14 about a horizontal, vertical, or skew axis. This substantial flexibility in varying the sensitivity of the control plate 28, as well as the flexibility in designing and adjusting the counterweight 32, allows the control plate 28 to be optimally adjusted so as to respond to transient requirements which occur during the frequent start-up and shutdown of both the forced air and natural draft furnaces.

As shown in FIG. 2, gravity aids the opening of control plate 28 and the counter weight 32 must overcome the gravity weight of the plate in order bias the control plate 28 against rectangular side plate 22 to substantially obstruct the air passageway through the air intake 14. This orientation of control plate 14 relative to the gravity vector is not required. For example, the control plate 28 can pivot about pivot axle 30″ or 30‴, in which case gravity would aid the closing of the air passageway through the air intake 14. This invention will function equally well whether the control plate 14 rotates about pivot axle 30 or 30″, or whether the control plate 28 rotates about pivot axle 30′ or 30‴. The counter weight 32 must be adjusted to account for the change in the gravity vector when the control plate 28 is rotated about pivot axle 30″ or 30‴; the control plate 28 still cooperates with the rest of the invention in the same manner as previously described, but allow flexible orientation of air intake 14, flexible design of counter weights 32, and varying sensitivity of control plate 28.

Figure 3:
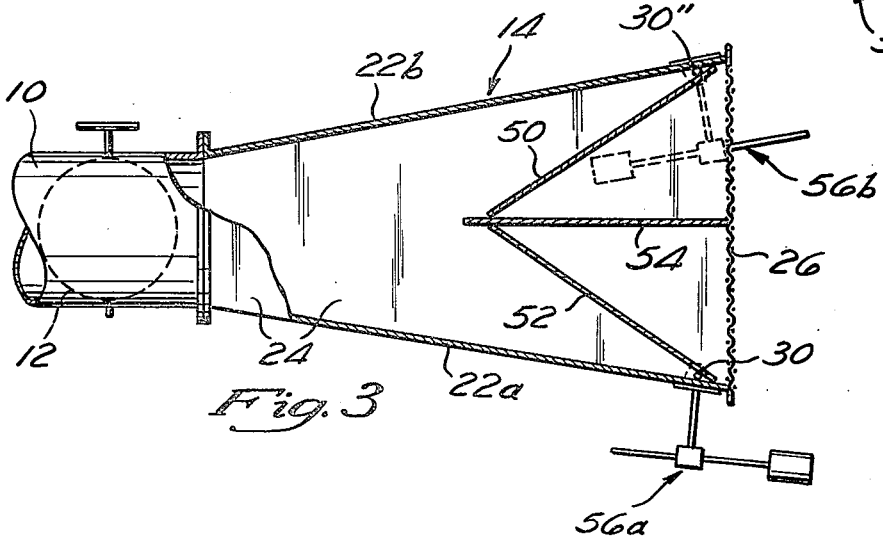
FIG. 3 illustrates an alternate embodiment of the present invention comprising two air intake control plates biased against a partition which is mounted between the plates.

FIG. 3 shows an alternate embodiment of this invention wherein there are two control plates mounted in a single air intake 14. A lower air intake control plate 52 (hereinafter lower control plate 52) is rotably mounted about pivot axle 30 located at the end of the lower control plate 52 nearest the turbulance screen 26. The pivot axle 30 is mounted on the lower rectangular side plate 22*a* near the turbulance screen 26. The lower control plate 52 is counterweighted by counter weight 56*a* against a partition 54 mounted on the air intake 14 so as to extend for a short distance along the axis of the air passageway through the air intake 14. The partition 54 is perpendicular to the turbulance screen 26 and attached to the trapezoidal sides 24 on the air intake 14. The partition 54 thus divides a short portion of the air intake 14 into two segments, at the end of the air intake 14 nearest the turbulance screen 26. The lower control plate 52 is counterweighted so as to substantially obstruct this lower portion of the air intake 14, while an upper air intake control plate 50 (hereinafter upper control plate 50) is biased against the partition 54 by counter weight 56*b* so as to substantially obstruct the air passageway through the upper segment of the air intake 14 as formed by the partition 54.

The upper control plate 50 is rotably mounted on pivot axle 30″ at the end of the upper control plate 50 nearest the turbulance screen 26. The pivot axle 30″ is mounted to the upper rectangular side plate 22*b* at the end of the air intake 14 nearest the turbulance screen 26. The upper control plate 50 is counterweighted so that the end distal from the pivot axle 30″ is biased against the partition 54 by counter weight 56*b*.

The counter weights 56*a* and 56*b* can be of the same type as previously described, and also as described in the U.S. Pat. No. 4,341,344, issued July 27, 1982 to applicant. The orientation of the counterweight 56*a* is rotated 180 degrees about rod 34 from that of counterweight 56*b*. This orientation change is required because gravity helps maintain the upper control plate 50 against the partition 54, while gravity tends to force the lower control plate 52 away from the partition 54. The counter weights 56*a* and 56*b* are independently adjusted to account for the effect of gravity, as well as to adjust the size of the opening of the air passageway which the air intake control plates 50 and 52 form as they pivot away from the partition 54.

This alternate embodiment illustrated in FIG. 3 has several advantages. One counter weight, for example counter weight 56*a*, can be adjusted to allow optimum combustion during the low firing level of the forced air draft furnace. The other counter weight 56*b*, can be adjusted to provide for optimum combustion during the high firing level of the furnace. Thus, during the low firing level of the furnace only the lower control plate 52 will be open to provide for optimum combustion, but during the high firing level of the furnace, both the lower control plate 52 and the upper control plate 50 will be open to allow for optimum combustion. Thus, a single air intake 14 can allow for optimum combustion at both a high firing level and a low firing level, without requiring two independent air intakes 14. Another advantage of the alternate embodiment illustrated in FIG. 3 is that flue gas can be recylced through only one of the control plates. By varying the adjustment between the upper control plate 50 and the lower control plate 52, an optimum combination of recylced flue gas versus ambient air can obtained. Alternately, the recylced flue gas can be recycled through the previously described embodiment wherein the lower control plate 52 is set for low firing level of the furnace, and the upper control plate 50 is set for the high firing level. This combination would allow the recycled flue gas to be used during either or both the low firing level and the high firing level of the furnace. Variations in pivot axle locations are also possible with this variation of the embodiment as shown in FIG. 3, and as discussed earlier in referring to pivot axles 30′ and 30‴.

The aforesaid description of the preferred embodiment is not given in terms of limiting the scope of the present invention, but is given by way of illustration only. There are numerous variations which would not exceed the spirit and scope of the present invention, such as varying the shape of the air inlet control plate 28 or the shape of the air intake 14.

What is claimed is:

1. A primary air inlet control system for controlling the inlet air volume in a forced air furnace, said furnace having means for forcing draft air into said air inlet, comprising:

funnel means located upstream from said draft forcing means for increasing the volume of laminar flow air admitted into said inlet, and reducing noise, said funnel means defining a passageway having its outlet in communication with said furnace air inlet;

control means pivotably mounted in said passageway, said control means being responsive to the forces exerted by gases in said passageway and providing leverage means whereby a small change in said control means produces a relatively large change in the volume of incoming gases to provide optimum combustion in said furnace;

means for adjustably pre-disposing said control means to obstruct said passageway to provide means for the prevention of thermal siphoning when the furnace blower is not in operation.

2. The air inlet control system of claim 1 further comprising a turbulence screen covering one opening of said passageway, said turbulence screen promoting a uniform rate of air intake by breaking up atmospheric turbulence.

3. The air inlet control system of claim 1 wherein said leverage means is a plate shaped so as to substantially obstruct said passageway when in a closed position and pivotably mounted about an axis parallel to the axis of the maximum moment of inertia such that a small rotation of said plate can affect a relatively large change in the unobstructed area of said passageway.

4. An air inlet control system controlling the volume of inlet air entering the primary air inlet passage in a forced draft furnace, said furnace having means for forcing draft air into said air inlet, comprising:

funnel means located upstream from said draft forcing means in communication with said inlet passage for increasing the volume of laminar flow air admitted into said inlet by reducing the effect of the drag-induced boundary layer;

an elongate plate;

means for mounting said plate in said funnel means such that a small rotation of said plate has a large effect on the volume of air inlet into said furnace through said funnel means, said plate requiring only a small rotation to open and close said air passageway in order to quickly respond to transient operating conditions in said furnace; and counterweight means located outside the air passageway communicating with said plate and predisposing said plate so as to substantially obstruct the passage of air through said funnel means into said air inlet.

5. The air inlet control system of claim 4, further comprising a turbulence screen on said funnel means which communicates with the air inlet so as to substantially reduce the effect of atmospheric turbulence upon said plate rotation.

6. An air inlet control system controlling the volume of inlet air entering an inlet passage in a furnace, comprising:

funnel means for increasing the volume of air admitted into said inlet;

an elongate plate;

means for mounting said plate in said funnel means such that a small rotation of said plate has a large effect on the volume of air inlet into said furnace through said funnel means, said plate requiring only a small rotation to open and close said air passageway in order to quickly respond to transient operating conditions in said furnace wherein the plate is pivoted about an axis parallel to the axis of the maximum moment of inertia, and located approximately a distance of one-third the plate length from the end of said plate which is most distant from the said air inlet of the force air furnace; and counterweight means communicating with said plate and predisposing said plate so as to substantially obstruct the passage of air through said funnel means into said air inlet.

7. The air inlet control system of claim 6 wherein:

said funnel means has a square shape at the end proximal to said air inlet, and has a rectangular shape at the end of the funnel means most distal from said air inlet;

said elongate plate has a substantially rectangular shape and is pivotally mounted to an axis parallel to the maximum moment of inertia of said plate and located at the end of said plate most distant from said air inlet, said plate nominally rotating through an angle of approximately 4 degrees in order to achieve optimal combustion of said furnace, and rotating through an angle of approximately 38 degrees in order to provide a substantially unobstructed air inlet passage;

two adjustable counterbalances, one located on each end of said pivot axle; and a turbulence screen in communication with the rectangular-shaped end of said funnel means.

8. An air inlet control system for controlling the inlet air volume entering an inlet passage in a furnace, comprising;

funnel means for increasing the volume of air admitted into said inlet, said means having at least a first and a second opening in communication with a first common passageway through said funnel means;

partition means for segmenting said first opening into at least two second passageways communicating with said first common passageway;

plates pivotally mounted so as to be able to substantially obstruct said second passageways, said plates being rotatably responsive and of sufficient sensitivity to respond to the force exerted by gasses in said funnel means;

counterweight means communicating with said plates and predisposing said plates to obstruct the air flow through said passageways; and means for mounting said funnel means so that the first common passageway through said funnel means is in communication with said air inlet passageway.

9. The air inlet control system of claim 8 further comprising a turbulence screen in communication with said openings so as to reduce the effects of atmospheric turbulence on the rotatably responsive plate, and also to prevent large debris from entering said funnel means.

10. The air inlet control system of claim 6 wherein that portion of the plate between the pivot axis and the end of the plate most distal from said air inlet, acts as a counterweight tending to predispose said plate so as to substantially obstruct the passage of air through said passageway.

11. An air inlet control system adapted for use on a forced draft furnace having a prime mover at the primary air inlet of said furnace, comprising:

channel means mounted on said furnace upstream of said prime mover and forming a passageway in communication with said air inlet, said channel means having an internal surface area forming a single boundary for the incoming air in said passageway, said channel means providing laminar flow means for said incoming air by smoothing out atmospheric turbulence and minimizing the effect of the drag-induced boundary layer created by the flow of said incoming air along said single boundary, whereby the volume of said incoming air is maximized and maintained substantially constant for optimal combustion conditions in said furnace;

throttling means mounted in said passageway of said channel means so as to substantially obstruct said passageway when in a closed position, said throttling means being in an open position during the operation of said furnace and responsive to changes in atmospheric conditions in said incoming air to regulate the volume of said incoming air, whereby efficient combustion is maintained; and means for predisposing said throttling means in a closed position when said furnace is not operating to prevent the loss of heat.

12. The air inlet control system of claim 11 wherein said throttling means comprises a leverage means whereby a small change in the position of said throttling means produces a relatively large change in the volume of incoming air.

* * * * *